United States Patent [19]

Kolmer

[11] Patent Number: 5,050,475

[45] Date of Patent: Sep. 24, 1991

[54] BULLET CASING DEBURRING TOOL

[76] Inventor: John Kolmer, 4890-145th St. West, Savage, Minn. 55378

[21] Appl. No.: 615,238

[22] Filed: Nov. 19, 1990

[51] Int. Cl.[5] ..... F42B 33/02

[52] U.S. Cl. ..... 86/23; 86/28; 86/33; 86/24; 29/1.3

[58] Field of Search ..... 86/23, 28, 31, 33, 24, 86/1.1; 29/1.32, 1.30

[56] References Cited

U.S. PATENT DOCUMENTS

| | | | |
|---|---|---|---|
| 827,866 | 8/1906 | Hart | 18/23 |
| 2,383,335 | 8/1945 | Moffitt | 407/30 |
| 2,406,170 | 8/1946 | Smiley | 29/1.32 |
| 2,443,807 | 6/1948 | Smiley | 29/1.32 |
| 2,722,028 | 11/1955 | Lynch et al. | 15/88.3 |
| 2,744,307 | 5/1956 | Smiley | 29/1.32 |
| 3,137,914 | 6/1964 | Manshel | 29/1.32 |
| 3,550,482 | 12/1970 | Lee | 408/228 |
| 3,628,225 | 12/1971 | Parker | 29/1.32 |
| 3,818,563 | 6/1974 | Beaulieu | 29/1.32 |
| 4,229,129 | 10/1980 | Schaenzer | 408/228 |
| 4,468,829 | 9/1984 | Christensen | 15/105 |
| 4,653,157 | 3/1987 | Alexander | 29/1.32 |
| 4,813,827 | 3/1989 | Dugger | 408/211 |
| 4,860,453 | 8/1989 | Carroll | 30/347 |

*Primary Examiner*—Deborah L. Kyle
*Assistant Examiner*—J. Woodrow Eldred
*Attorney, Agent, or Firm*—Robert W. Gutenkauf; L. Paul Burd; Richard O. Bartz

[57] ABSTRACT

An apparatus to recondition used ammunition cartridge cases in order that they can be reloaded and reused. A stand includes a base and an upright column. A plurality of bearing sleeves are located in the column disposed about parallel horizontal axes. A plurality of tool holders have shafts that are rotatably assembled in the column. The tool holders carry cartridge case reconditioning tools of the type that operate upon a cartridge case upon rotation with respect to it. The tool holder shafts are interconnected by circular gears. The rotation of one shaft results in rotation of the other shafts. A crank is connected to one of the shafts for rotation of all of the shafts. One of the cartridge case reconditioning tools is for deburring the inside mouth of the case, another is for deburring the outside mouth of the case, and a third is for cleaning the primer pocket. As the crank arm is rotated to rotate all of the cartridge case reconditioning tools, the cartridge case is moved from one tool to the next in a reconditioning procedure.

17 Claims, 2 Drawing Sheets

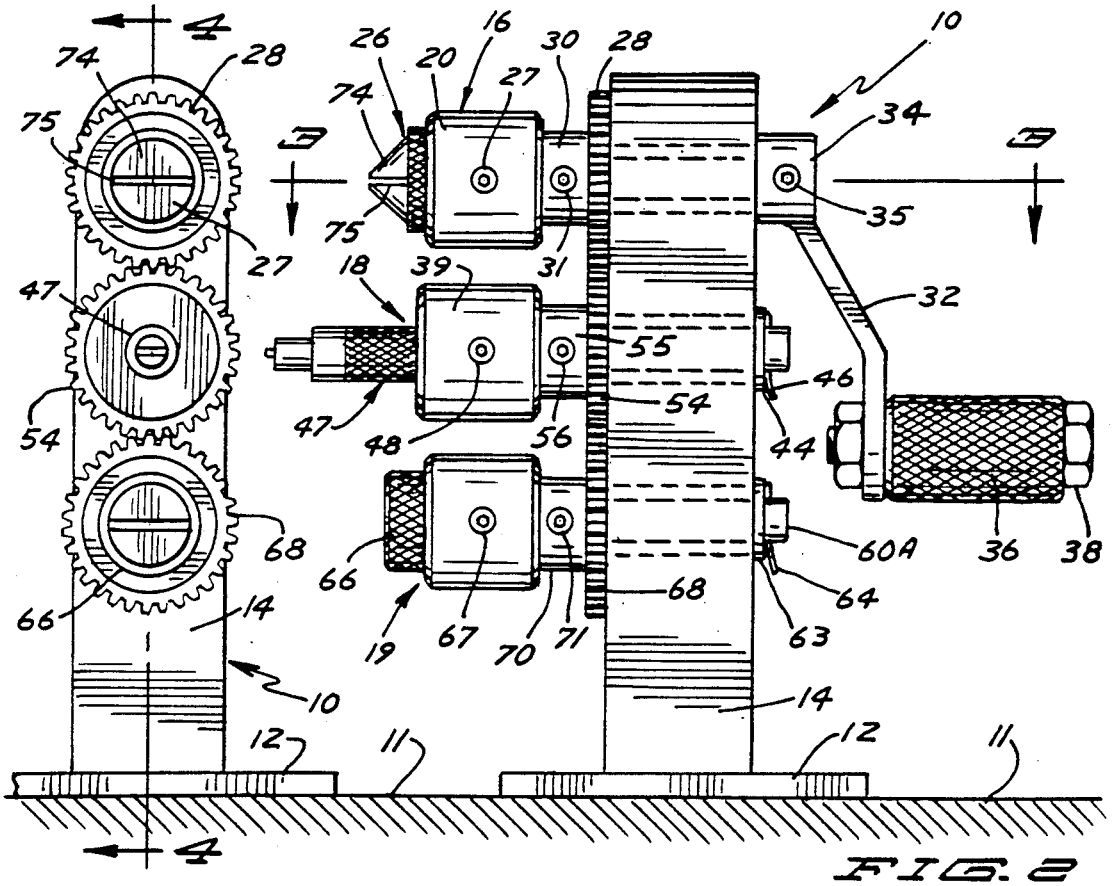
FIG. 1
FIG. 2
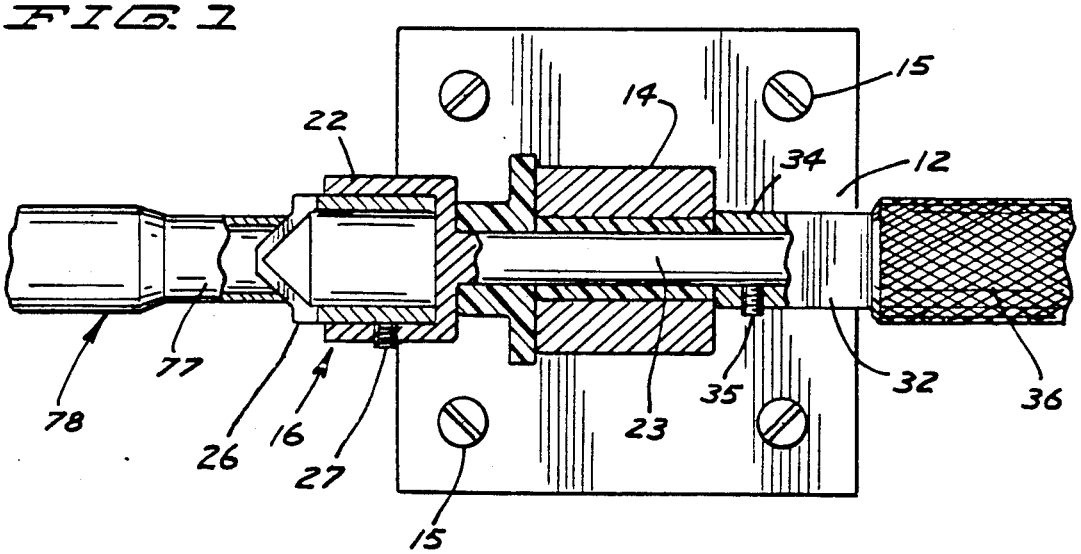
FIG. 3

BULLET CASING DEBURRING TOOL

BACKGROUND OF THE INVENTION

Reuse of cartridge cases of rifle and pistol ammunition rounds for purposes of economy is popular. Careful reconditioning of the cartridge case can permit reuse at least several times. The cartridge case is commonly made of brass. When assembled the mouth of the case is crimped to hold the bullet. Upon discharge the cartridge case can be stretched resulting in a case length exceeding a permissable limit. For reuse the case is normally resized. This also can result in a case length exceeding a permissable limit. It is necessary to trim the case to achieve the desired length. The trimming procedure causes the edge of the mouth of the case to be left significantly burred both on the inside and the outside. For reuse the burrs must be removed. Both the outer and the inner edges of the mouth must be beveled. The inner edge must be beveled for the receipt of the bullet and the outer edge for insertion of the cartridge in the gun. This can be done manually by a small hand tool of the type shown in U.S. Pat. No. 3,550,482 issued June 26, 1968 to Lee. The tool is hollow and has a conical tip with a slot forming diametrically opposed inner and outer cutting edges. The outer cutting edges remove the burrs from the inside of the mouth of the cartridge case and leave a bevel. To remove the burrs on the outer edge of the mouth of the case, the tool is turned around and the mouth of the case is inserted into the tool to a point of contact with the inner cutting edges. The tool is axially rotated to remove the burrs on the outer edge of the case. In addition, upon reconditioning of a cartridge case the primer pocket must be cleaned of residue from detonation of gunpowder.

SUMMARY OF THE INVENTION

The invention relates to an apparatus to recondition used ammunition cartridge cases in order that they can be reloaded and reused. The apparatus includes a stand having a base and a pedestal or column. A plurality of rotatable case reconditioning tools are fixed on shafts for axial rotation. The shafts are rotatably assembled to the column in parallel relationship. A crank handle is connected to one of the shafts for manual rotation thereof. The shafts are interconnected by gears. Rotation of one shaft results in rotation of the other shafts such that the three tools rotate simultaneously. The tools are poised adjacent one another. One tool is for deburring the inside of the mouth of the case. Another tool is for cleaning the primer pocket of the case. The third tool is for deburring the outer edge of the mouth of the case. A used case is held in one hand and the crank is rotated with the other hand to simultaneously rotate all of the tools. The case is quickly and sequentially moved from one tool to the next in a reconditioning process involving deburring the inner edge and outer edge of the mouth of the case and cleaning of the primer pocket.

IN THE DRAWINGS

FIG. 1 is a front elevational view of a cartridge case reconditioning apparatus according to the invention;

FIG. 2 is a side elevational view of the cartridge case reconditioning apparatus of FIG. 1;

FIG. 3 is an enlarged sectional view of a portion of a cartridge case reconditioning apparatus of FIG. 2 taken along the line 3—3 thereof.

DESCRIPTION OF A PREFERRED EMBODIMENT

Figure 4:
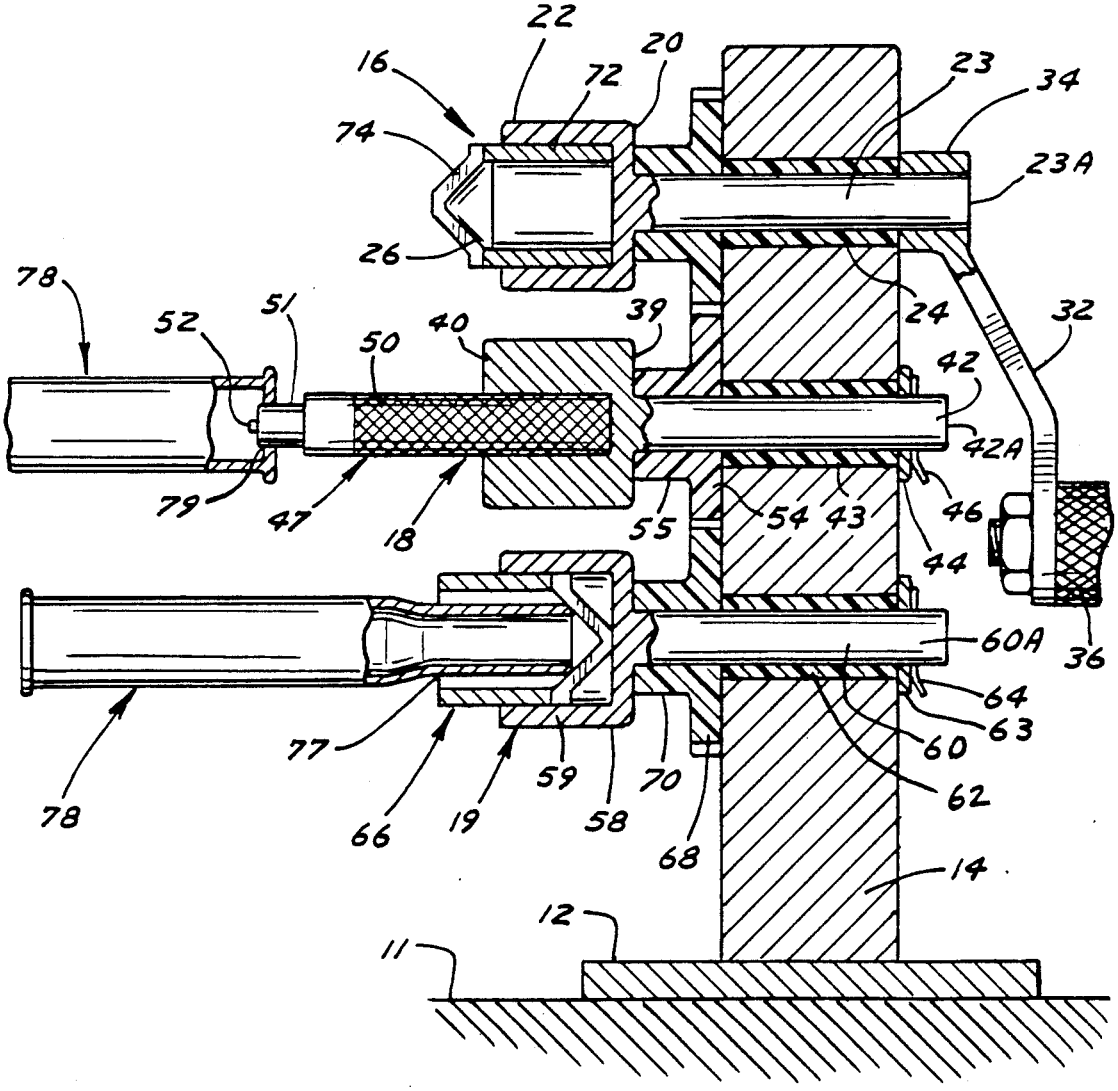
FIG. 4 is an enlarged sectional view of a portion of the cartridge case reconditioning tool of FIG. 1 taken along the line 4—4 thereof.

Referring to the drawings, there is shown a cartridge case reconditioning apparatus indicated generally at 10 mounted on a work surface 11 such as a work bench. Reconditioning apparatus 10 includes a stand comprised as a flat horizontal base 12 and an elongate pedestal or column 14 extending upward perpendicular from the base 12. Base 12 can be secured to work surface 11 by suitable means such as the screws 15 shown in FIG. 3.

Column 14 carries first, second and third tool assemblies 16, 18 and 19 for performance of various reconditioning procedures on a used cartridge case. The tool assemblies are effective for deburring the inside of the mouth of the case, for deburring the outside mouth of the case and for cleaning the primer pocket so that the cartridge can be reloaded and used again. The first tool assembly 16 includes a first tool holder 20 having a chuck end or cup end 22 for mounting a tool and a shaft 23. Shaft 23 is rotatably assembled in a sleeve bearing 24 located in a suitable opening in the column 14 and formed of a suitable low friction material such as Teflon. The shaft 23 is rotatable about a horizontal axis perpendicular to the longitudinal dimension of the column 14. The cup end 22 carries a deburring tool 26. Cup end 22 is cylindrical and has an inside dimension for a snug fit of the outer walls of the deburring tool 26. A set screw 27 releasably holds the deburring tool 26 in place.

A first circular gear 28 is fixed to a gear collar 30 which is fixed to the shaft 23 by a set screw 31 and is positioned between the cup end 22 of tool holder 20 and the column 14. Circular gear 28 is positioned adjacent the side wall of the column 14. One end 23A of tool holder shaft 23 extends outwardly of the opposite side of the column 14. A handle assembly includes a crank arm 32 having a hub end 34 fixed to the end portion 23A of the shaft 23 by a set screw 35. A handle 36 is located at the opposite end of the crank arm 32 held thereon by a nut and bolt assembly 38. Circular movement of the handle 36 is effective to rotate the shaft 23 and accordingly the deburring tool 26.

Second tool assembly 18 includes a second tool holder 39 having an enlarged cylindrical cup end 40 and a shaft 42. Shaft 42 is rotatably mounted in a sleeve bearing 43 assembled in the column 14 in parallel relationship to the first sleeve bearing 24 and disposed vertically beneath it. An end 42A extends outwardly of the opposite side of the column 14 and is surrounded by a washer 44 and retained by a cotter pin 46. The cup end 40 of tool holder 39 carries a primer pocket cleaning tool 47 secured by a set screw 48. Primer pocket cleaning tool 47 is the type having a cylindrical shank 50 secured in the cup end 40 of tool holder 39. A reduced diameter neck 51 extends from the end of the shank 50. A blade 52 extends transversely across the end of the neck 51 for engagement of and cleaning of a primer pocket upon rotation of the shank 50.

A second circular gear 54 is connected to a gear collar 55 which is mounted on the second tool holder shaft 42 and held thereon by a set screw 56 positioned beneath the first gear 28 and in meshing relationship with the first gear 28 such that rotation of the crank handle 32 results in rotation of the first gear 28 and counter-rotation of the second gear 54 for counter-rotation of the second shaft 42 and the second tool assembly 18.

Third tool assembly 19 includes a third tool holder 58 having an enlarged cylindrical cup end 59 and a shaft 60. Shaft 60 is rotatably mounted in a sleeve bearing 62 assembled in the column 14 in parallel relationship to the second sleeve bearing 43 and disposed vertically beneath it. An end 60A extends outwardly of the opposite side of the column 14 and is surrounded by a washer 63 and retained by a cotter pin 64. The cup end 59 of tool holder 58 carries a deburring tool 66 retained therein by a set screw 67. Tool 66 is for deburring the outer edge of the mouth of a shell case. A third circular gear 68 is fixed to a gear collar 70 which is fixed to the shaft 60 by a set screw 71 and is positioned between the cup end 59 of the tool holder 58 and the column 14. Circular gear 68 is in meshing engagement with the second gear 54 such that rotation of the second gear 54 results in rotation of the third gear 68 in an opposite direction.

First deburring tool 26 of the first tool assembly 16 and the second deburring tool 66 of the third tool assembly 18 can be alike in construction and like that tool shown in U.S. Pat. No. 3,550,482 to Lee. The deburring tool 26 has a hollow cylindrical body 72 and a conical head 74. A diametric slot 75 intersects the head 74 forming both interior and exterior cutting edges. The slot 75 divides the head 74 into non-symetric halves to form offset cutting edges functional in only one direction of rotation as described in U.S. Pat. No. 3,550,482. The first deburring tool 26 is installed in the cup end 22 of the first tool holder 20 with the conical head portion 74 pointed outward. In this orientation the tool is effective to deburr the inside edge of the mouth of a cartridge case. The second deburring tool 66 mounted in the cup end 59 of the third tool holder 58 is mounted therein with the conical head facing inwardly and access to the interior of the body portion from the outside. In this configuration, the tool is effective to deburr the outer edge of the mouth of a shell casing.

In use, handle 36 is rotated to rotate the crank arm 32 and the shaft 23 of the first tool holder 20. This rotates the first deburring tool 74 and simultaneously causing rotation of the first gear 28, second gear 34 and third gear 68 to simultaneously rotate the pocket primer cleaning tool 47 and the second deburring tool 66. A cartridge case to be reconditioned is sequentially moved between the first, second and third tool holding assemblies 16, 17 and 18. At the first tool assembly 16, as shown in FIG. 3, the mouth 77 of a cartridge case 78 is placed in contact with the conical head 74 of the first deburring tool 26. The cutting edge of the slot 75 removes interior burrs from the mouth 77 and leaves a beveled edge. The cartridge case 78 is then moved to the second tool assembly 18 where the end 79 is engaged with the tip or cutting blade 52 of the reduced neck 51 of the pocket primer cleaning tool 47. The primer pocket of the cartridge case is cleaned and ready for reuse. The cartridge case 78 is then moved to the third tool assembly 19 where the mouth 77 is inserted into the hollow end of the second deburring tool 66. The cutting edges of the slot at the conical head of the interior head of the tool engage the outer edge of the tip of the mouth 77 of the cartridge case 78 to deburr the outer edge and bevel it as well. The procedure is quickly accomplished wih the user continuously turning the crank arm 32.

While there has been shown and described a preferred embodiment of a cartridge case reconditioning apparatus according to the invention, it will be apparent that certain deviations can be had without departing from the scope and spirit of the invention.

The embodiments of the invention in which exclusive property or priviledge is claimed are defined as follows:

1. A cartridge case reconditioning apparatus comprising:

column means;

a first tool holder;

means mounting the first tool holder on the column means;

a first gear connected to the first tool holder;

a first reconditioning tool mounted on the first tool holder;

a second tool holder;

means mounting the second tool holder on the column means;

a second hear connected to the second tool holder and in meshing engagement with the first gear;

a second reconditioning tool mounted on the second tool holder;

a third tool holder;

means rotatably mounting the third tool holder on the column means;

a third gear connected to the third tool holder and in meshing engagement with the second gear;

a third reconditioning tool mounted on the third tool holder;

means for manual rotation of one of said tool holders resulting in rotation of the other tool holders for reconditioning a spent cartridge case;

one of said reconditioning tools comprised as a tool to deburr the outside edge of the mouth of a cartridge case;

another of said reconditioning tools comprised as a tool to deburr the inside edge of the mouth of a cartridge case; and another of said reconditioning tools comprised as a tool to clean the primer pocket of a cartridge case.

2. The cartridge case reconditioning apparatus of claim 1 wherein:

each tool holder includes a shaft, said shafts of the tool holders being positioned in parallel relationship.

3. The cartridge case reconditioning apparatus of claim 2 wherein:

means for manual rotation of one of said tool holders includes a crank handle connected to one of said shafts.

4. The cartridge case reconditioning apparatus of claim 3 wherein:

said column means includes an elongate column;

said tool holders are assembled to the column in vertically aligned relationship when the column is in a generally vertical orientation.

5. The cartridge case reconditioning apparatus of claim 4 including:

first, second and third sleeve bearings mounted in the column, said shafts of the tool holders being rotatably assembled in the sleeve bearings.

6. The cartridge case reconditioning apparatus of claim 5 wherein:

each tool holder includes a cup end connected to the mounting shaft, said reconditioning tools being releasably assembled to the cup ends of the tool holders.

7. A cartridge case reconditioning apparatus comprising:

a stand having an elongate column;

first, second and third tool holders having first, second and third tool holder shafts;

first, second and third bearing means located in the column;

said first, second and third tool holder shafts assembled in the first, second, and third bearing means for axial rotation;

said first tool holder having a first gear;

said second tool holder having a second gear disposed in meshing engagement with the first gear;

said third tool holder shaft having a third gear disposed in meshing engagement with the second gear;

first, second, and third cartridge case reconditioning tools connected to the first, second, and third tool holder;

manual crank means connected to one of said tool holders for rotation of the tool holder and consequent rotation of the other tool holders;

one of said reconditioning tools comprised as a tool to deburr the outside edge of the mouth of the cartridge case;

another of said reconditioning tools comprised as a tool to clean the primer pocket of a cartridge case; and another of said reconditioning tools comprised as a tool to deburr the inside edge of the mouth of the cartridge case.

8. The cartridge case reconditioning apparatus of claim 7 wherein:

said first, second and third bearing means are comprised as bearing sleeves located in said column.

9. The cartridge case reconditioning apparatus of claim 8 wherein:

said first, second and third bearing sleeves are disposed in generally vertical alignment on the column when the column is generally vertically orientated.

10. The cartridge case reconditioning apparatus of claim 9 wherein:

said crank means is comprised as a crank arm having one end fixed to an end of one of the tool holder bearing shafts and an opposite end having a handle to be manually grasped and rotated.

11. The cartridge case reconditioning apparatus of claim 10 wherein:

said first tool is a tool to deburr the inside edge of the mouth of a cartridge case;

said second tool is a tool to clean the primer pocket of a cartridge case;

said third tool is a tool to deburr the outside edge of the mouth of the cartridge case;

said second tool located between the first and third tools.

12. The cartridge case reconditioning apparatus of claim 11 including:

means releasably holding the first, second and third tools in the tool holders.

13. The cartridge case reconditioning apparatus of claim 12 wherein:

said first and third tools are of the type having a hollow cylindrical body and a conical head with a diametric slot forming inner and outer cutting edges.

14. A cartridge case reconditioning apparatus comprising:

a stand including a base and an elongate column extending upward from the base;

a first sleeve bearing assembled in the column and disposed about a generally horizontal axis;

a first tool holder having a shaft rotatably assembled in the first sleeve bearing and having a first tool holding chuck at one end of the shaft;

a first cartridge case reconditioning tool releasably mounted in said first chuck;

a first circular gear assembled to the first shaft;

a second sleeve bearing assembled in the column and disposed about a generally horizontal axis in parallel relationship to the axis of the first sleeve bearing, said second sleeve bearing located vertically beneath the first sleeve bearing;

a second tool holder having a second shaft rotatably assembled in the second sleeve bearing and having a second tool holding chuck at one end of the shaft;

a second cartridge case reconditioning tool releasably mounted in the second tool holding chuck;

a second circular gear assembled to the second shaft and in meshing engagement with the first circular gear;

a crank having a first end assembled to one end of one of said tool holder shafts opposite the chuck, and an opposite end having a handle for rotational movement to rotate the first and second tool holder shafts.

15. The cartridge case reconditioning apparatus of claim 14 wherein:

one of said reconditioning tools is a tool to deburr the edge of the mouth of the cartridge case;

another of said reconditioning tools being a tool to clean the primer pocket of a cartridge case.

16. The cartridge case reconditioning apparatus of claim 15 including:

a third sleeve bearing assembled in the column and disposed about a horizontal axis parallel to the horizontal axis of the second sleeve bearing, said third sleeve bearing located beneath the second sleeve bearing;

a third tool holder having a third shaft rotatably assembled in the third sleeve bearing and having a third tool holding chuck located at one end of the shaft;

a third cartridge case reconditioning tool mounted in the third tool holding chuck;

another circular gear disposed on the third tool holder shaft and in meshing engagement wih the second circular gear for rotation therewith.

17. The cartridge case reconditioning tool of claim 16 wherein:

a third of said cartridge case reconditioning tools comprised as another tool to deburr the mouth of a cartridge case.

* * * * *